United States Patent [19]

Bruce

[11] Patent Number: 4,864,955

[45] Date of Patent: Sep. 12, 1989

[54] ANCHOR ORIENTATION DEVICE

[76] Inventor: Peter Bruce, Elm Tree House, Onchan, United Kingdom

[21] Appl. No.: 262,180

[22] Filed: Oct. 26, 1988

Related U.S. Application Data

[63] Continuation of Ser. No. 148,504, filed as PCT GB87/00385 on Jun. 6, 1987 published as WO87/07574 on Dec. 17, 1987, abandoned.

[30] Foreign Application Priority Data

Jun. 4, 1986 [GB] United Kingdom ..... 8613485

[51] Int. Cl.[4] ..... B63B 21/22

[52] U.S. Cl. ..... 114/210

[58] Field of Search ..... 114/179, 293, 294, 219, 114/301-303, 310

[56] References Cited

U.S. PATENT DOCUMENTS 2,937,610 5/1960 Rutledge ..... 114/210

3,635,187 1/1972 Webb ..... 114/210

*Primary Examiner*—Joseph F. Peters, Jr.

*Assistant Examiner*—Jesûs D. Sotelo

[57] ABSTRACT

An anchor orientating device (1) to ensure that an anchor (2) comes over a ship's stern roller (3) on its back i.e. fluke outermost comprises an elongate body (4) carrying a transverse cordioid shaped cam (5) inclined backwardly on the body (4), the front of the body (4) being adapted for attachment to an anchor cable (7) and the rear, in substantial non-rotational manner, to an anchor. Reaction of the cam (5) with the roller surface causes device (1) to rotate so as to pivot the anchor to a fluke outermost position and to bring a stabilizing cam land (16) into engagement with the surface. The device (1) additionally includes a secondary reaction surface (20) which reacts with a smaller diameter bolster bar (21) of an anchor rack to further rotate the anchor and so enable the anchor fluke (2A) to engage the bolster bar (21) for anchor store.

16 Claims, 4 Drawing Sheets

ANCHOR ORIENTATION DEVICE

This application is a continuation of application Ser. No. 148,504, filed as PCT GB87/00385 on Jun. 6, 1987, published as WO87/07574 on Dec. 17, 1987, now abandoned.

The present invention relates to a device for attachment to an anchor capable of controlling the angular orientation of the anchor as it is hauled onboard over a stern roller of an anchor handling vessel.

When decking a fixed fluke anchor by hauling it over a stern roller of an anchor handling vessel by means of a cable, it is advantageous to cause the anchor to rotate about the axis of the cable until its fluke points away from the vessel to permit the anchor to ride over the stern roller on its back to avoid snagging its fluke on the stern roller. Hitherto, this has been accomplished by using propeller wash to rotate the anchor to the desired attitude. This suffers the disadvantage of being uncertain in choppy seas which prevent visual identification of the initial orientation of the anchor on arrival at the stern roller.

It is an object of the present invention to provide a device capable of impressing a preferred angular orientation on an anchor as it is decked.

According to the present invention an anchor orientating device includes a body member elongated along an axis of the device adapted at a forward end for attachment to a cable and at an after end for attachment to an anchor shank or a cable and a transverse cam member attached thereto so adapted that the cam member can react with a cylindrical firm surface to cause operative orientation of the device.

Preferably the cam member bears a peripheral edge forming a stability creating surface means at one side of said axis and a non-stable second surface portion or peak at an opposite side of said axis whereby, on being dragged over a cylindrical firm surface with same second surface portion in contact with said firm surface, the device tends to topple away from the peak and roll on said cam member to bring the stability creating surface means into stable contact with said firm surface.

Preferably the stability creating surface means comprises a land.

Preferably said peak of the cam member is located forward of the stability creating surface means.

Preferably the peripheral edge of the cam member is substantially contained in a plane.

Preferably the plane of the periphery of the cam member is inclined to the axis of the device.

Preferably the plane of the periphery of the cam member is inclined to the axis of the device in the range 40° to 80° and preferably 50° to 65°.

Preferably the land is closer than the peak to the axis of the device.

Preferably the cam member periphery is of cardioid shape.

Figure 1:
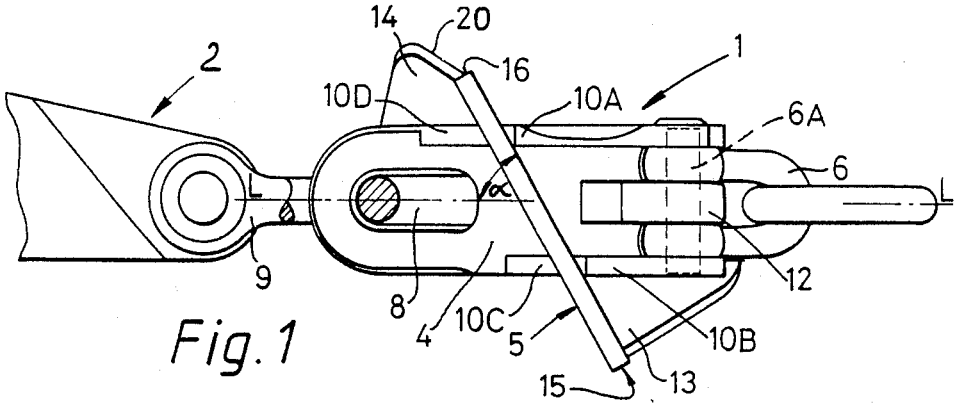
Figure 2:
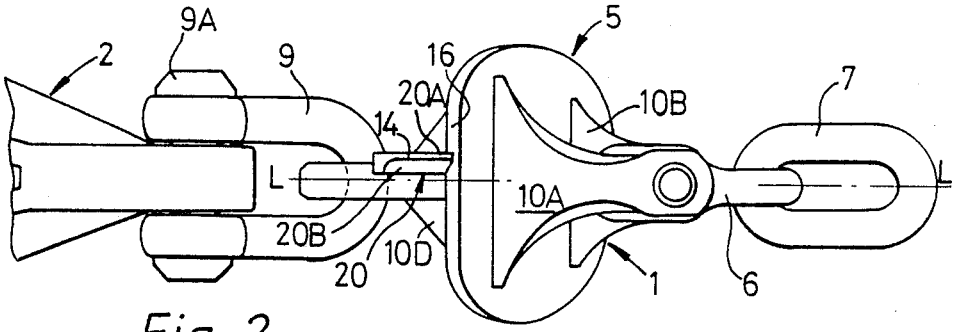
Figure 3:
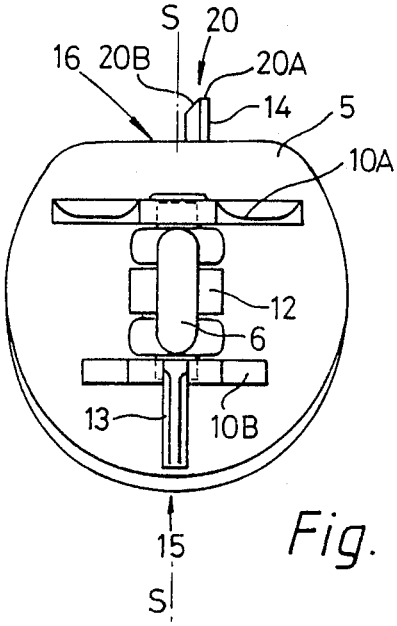
Figure 4:
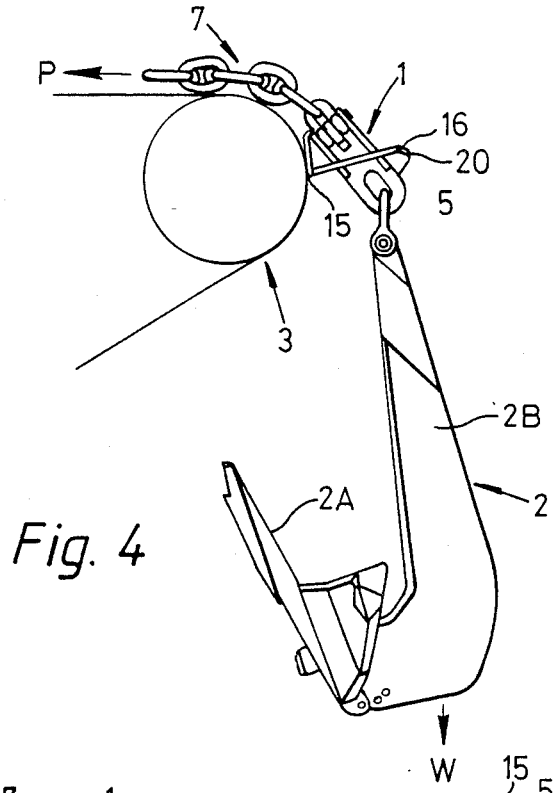
Figure 5:
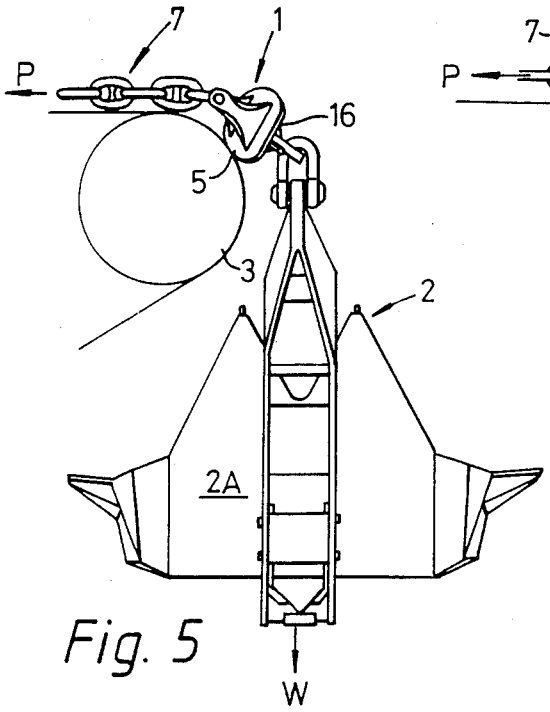
Figure 6:
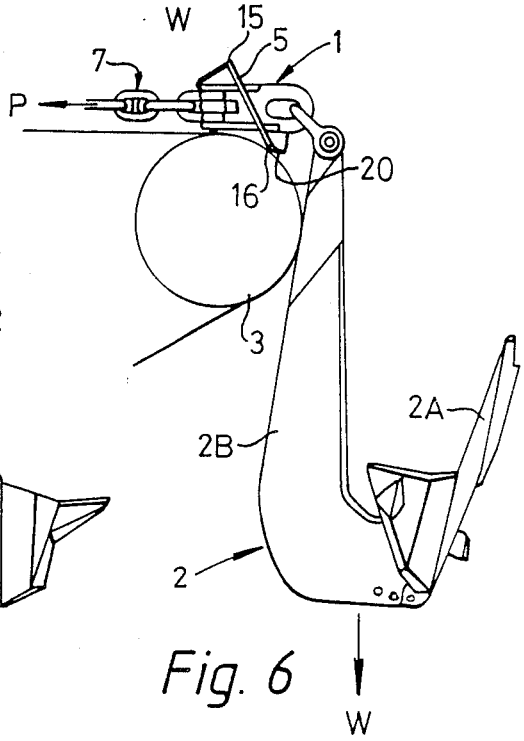
Figure 7:
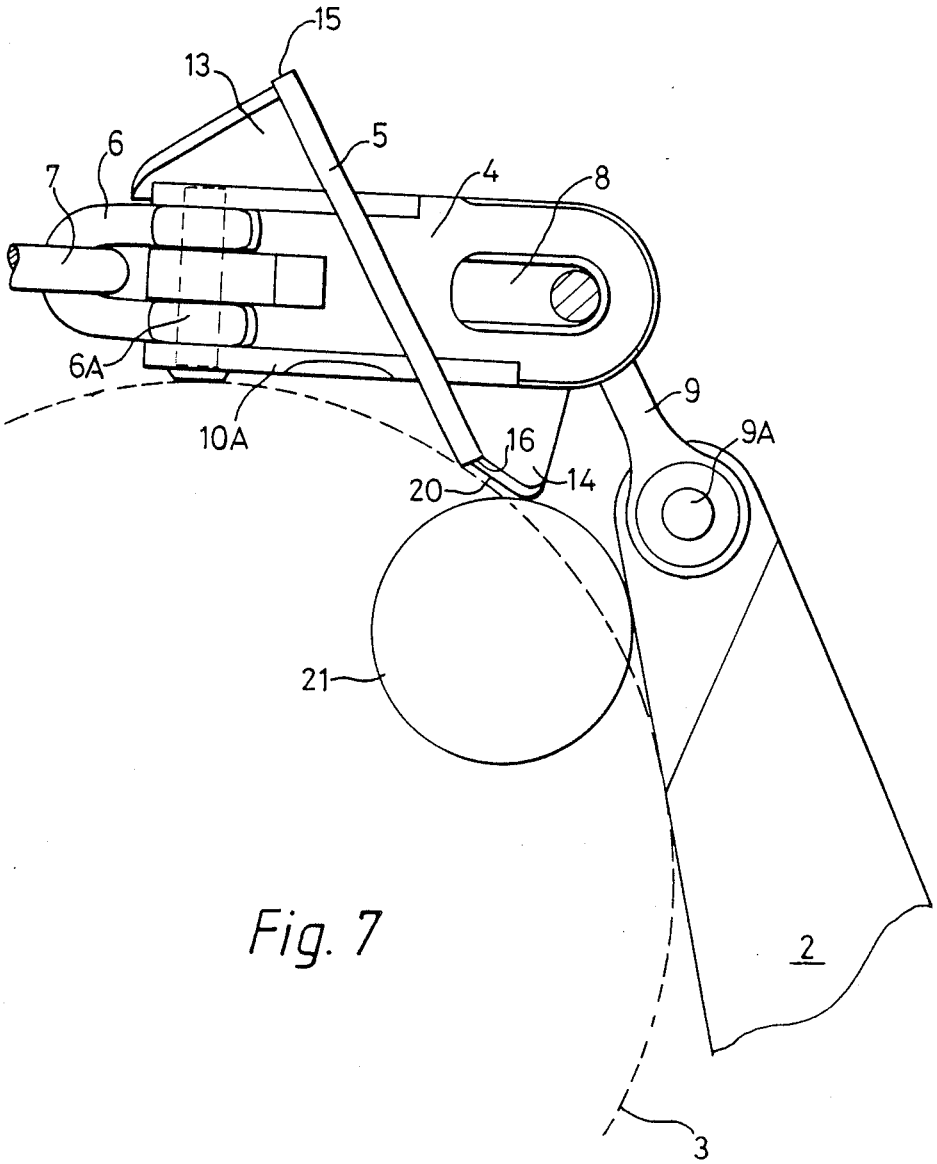
Figure 8:
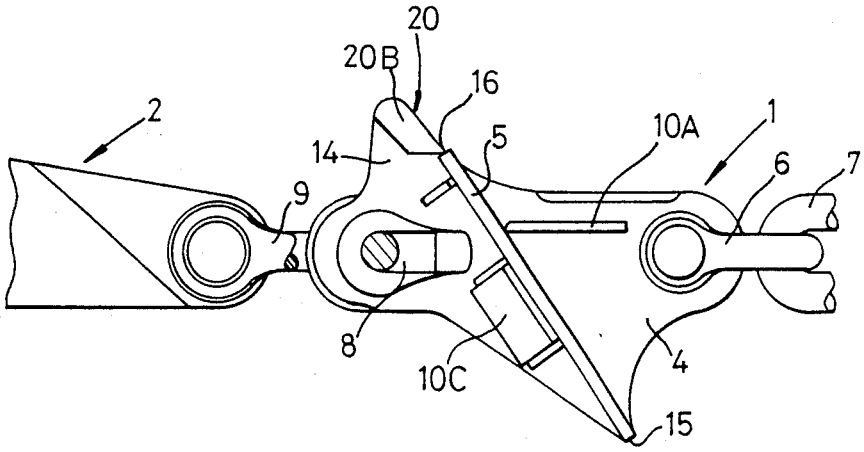
Figure 9:
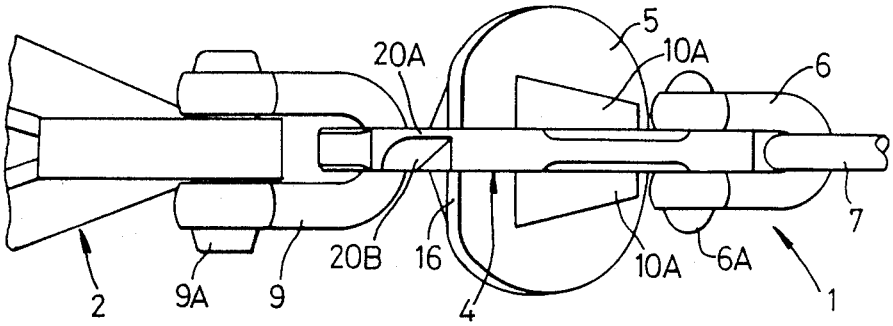

An embodiment of the present invention will now be described by way of example with reference to the accompanying drawings wherein:

FIG. 1 shows a side elevation of an anchor orientating device according to the present invention, FIG. 2 shows a plan view of the device of FIG. 1, FIG. 3 shows a front view of the device of FIG. 1, FIGS. 4 to 6 show stages of operation of the device when fitted to an anchor and moving over the stern roller of an anchor handling vessel, FIG. 7 shows a side elevation of the device similar to that of FIG. 6 but to a larger scale and with the device passing over a bolster bar of an anchor rack, FIG. 8 shows a side elevation of a modified anchor orientating device in accordance with the present invention, and FIG. 9 shows a plan view of the device of FIG. 8.

Referring to FIGS. 1 to 3 of the drawings, an anchor orientating device 1 is provided for orientating a marine anchor 2 as it moves over the stern roller 3 of an anchor handling vessel. Specifically the device 1 ensures that the anchor 2 comes over the roller 3 on its back thereby preventing snagging of the anchor at the roller. The device 1 comprises a body member 4 having a longitudinal axis L—L and heart shaped cam member 5 extending tranversely to the body member 4, the cam member 5 serving to roll the device 1 (and the attached anchor) when the device passes over a ship's stern roller so that the anchor passes over the roller on its back, i.e. fluke member outermost. The front end of the member 4 carries a shackle link 6 which is attachable to the anchor chain cable 7 so that the axis L—L of the member 4 can be aligned with the axis of the chain cable 7 when the chain is straight and taut, while the rear end of the member 4 has a slot 8 aligned with axis L—L to receive a front shackle 9 of the anchor 2. The cam member 5 is strengthened by transverse plates 10A, 10B, 10C, 10D, and two of these plates 10A, 10B include bores receiving ends of the pin 6A of link 6, a central journal boss 12 providing additional support for the pin 6A thereby reducing shear loads on the pin.

The cam member 5 has a cardioid shaped periphery and is set at suitable angle $\alpha$ relative to the axis L—L.

In the present example the cam 5 is backwardly inclined relative to the axis L—L and angle $\alpha$ has a value approximately 55°-60° but angle $\alpha$ could lie in any suitable range for example in the range 40° to 80°. A forward peak 15 of the cardioid periphery defining a non-stable cam surface portion lies below the axis L—L, while the top of the cam 5 (rearwardly located relative to peak 15) is in the form of a transverse land 16 lying above the axis L—L and defining a stable cam surface portion. It is arranged that the land 16 is closer to the axis L—L than the peak 15.

A plate 14 extends rearwardly from the cam member 5 adjacent the land 16 and parallel to the symmetry plane S—S (FIG. 3) of the cam member 5. The plate 14 presents a peripheral edge portion 20 which extends backwardly from the land 16 at an outwardly inclined angle relative to the axis L—L so that the edge portion 20 is located above the land 16 when the device is viewed from the front (FIG. 3). The edge portion 20 has the function of rolling the anchor 2 back towards a fluke lowermost position (as will be explained later) when the device 1 subsequently engages the bolster bar of an anchor rack (not shown). The edge 20 comprises an outer edge surface 20A of relatively narrow width flanked by a wider bevel portion 20B, and to assist the backward rolling action the outer edge surface 20A is laterally spaced from the symmetry plane S—S of the cam member 5. The plate 14 additionally serves as a reinforcement for the cam member 5 which is further supported by a longitudinal web plate 13.

The size relationship of the slot 8 and the shackle 9 is such that a definite rotational constraint will be present between the device 1 and the anchor 2, so that rotation of the device 1 about axis L—L will cause substantially equivalent rotation of the anchor 2. The anchor 2 shown in the example is in accordance with the present applicants International Application PCT/GB86/00522 (WO/87/01347).

The device 1 will be made of suitable quality steel.

Referring especially to FIGS. 4 to 6, in operation of the device 1 when the anchor 2 is raised towards the anchor handling vessel such that the anchor fluke 2A is inwardly directed relative to the vessel's hull (as shown in FIG. 4) the peak 15 of the cam member 5 will engage the roller 3. By virtue of the directions of the pull P on the anchor cable 7 and the weight component W of the anchor 2 substantial frictional contact and bearing pressure will exist between the cam member 5 and the roller 3. Also the position of cam member 5 shown in FIG. 4 is unstable so that as the device 1 is dragged over the surface of roller 3 the device 1 will topple away from the peak 15 into the position shown in FIG. 5 and the device 1 will continue to roll on the cam member 5 to bring the land 16 into contact with roller surface as shown in FIG. 6. The anchor 2 is consequently rolled through 180° in this operation with the result that the anchor 2 is pulled on its back over the roller 3 with the outer edge of the shank 2B engaging the roller surface (as shown in FIG. 6) and with the fluke 2A now directed outwardly relative to the vessel's hull so that snagging of the fluke at the roller is precluded. Land 16 makes stable contact with the roller surface with the result that the anchor will be stabily orientated in FIG. 6. It should be pointed out that device 1 is shown somewhat overscale in FIGS. 4 to 6 for clarity.

FIG. 7 illustrates the situation when the device 1 with anchor 2 attached has moved into contact with a bolster bar 21 of an anchor rack with the device and the anchor still positioned as shown in FIG. 6 ie. with the anchor fluke 2A outermost. It is estabished practice in the art that the diameter of the bolster bar of an anchor rack is always substantially less than the diameter of the ship's stern roller 3. In particular the stern roller usually has a diameter greater than 4 feet (1.212 m) and a common diameter for this roller is 6 feet (1.818 m) while, on the other hand, the bolster bar has a diameter less than 3 feet (0.91 m). The edge 20 projects laterally beyond the land 16 by a distance such that when the device 1 moves over the bar 21 as shown in FIG. 7 the edge 20 engages the bar surfaces to raise the land 16 clear of this surface so that the device 1 is supported by the edge 20. However, in this situation the device 1 is unstable and the pulling force on the anchor cable (ie. through link 7) imparts a turning force on the device 1, accentuated by the off-set of the edge surface 20A from the plane S—S, so that the device 1 topples thereby rotating the anchor 2 to bring the fluke 2A towards an inward facing position (ie. per FIG. 4), and on further upward movement of the anchor 2 in this situation the fluke 2A will engage the bar 21 for effective anchor storage. When the device 1 is moving over the larger diameter roller 3 with the land 16 engaging the roller surface the edge 20 is precluded from engaging this surface as can be seen in FIG. 6 (and even more clearly in FIG. 7 where the dashed line 3 represents part of a circle of stern roller radius). It will be understood, therefore, that the cam member 5 and the edge 20 are sized responsive to the radius of the curved surface (ie. the running surface) over which the cam member 5 and edge 20 are moving: thus it is arranged that for running surface radii greater than say 2 feet (0.61 m) the land 16 functions to maintain the device 1 in a stable condition with the edge 20 inoperative while for a running surface radius of 1.5 feet (0.45 m) or less the edge 20 comes into play to tilt the device 1, with the land 16 inoperative.

While the above embodiment describes the use of the device 1 to orientate an anchor for passage over a ship's stern roller it will be understood that the device 1 could be used to orientate an anchor in other situations. For example the device 1 could be used to orientate an anchor so as to enable appropriate stowing of the anchor in a hawse pipe of a ship, and this could be achieved by suitably shaping the hull plating at the entrance to the hawse pipe for reaction with the cam member 5. In particular, as the anchor is raised towards the hawse pipe it could be desirable to orientate the anchor so that the fluke points away from the ship's hull before the anchor can engage the ship's hull: this would reduce the likelihood of damage to the hull plating by the anchor. This feature could be achieved by placing a suitable length of rotationally constrained cable between the device 1 and the anchor whereby rotation of the device 1 still results in substantially equivalent rotation of the anchor 2.

Modifications are of course possible. Thus the periphery of the cam member 5 could take some other form than that shown in the drawings, and in particular a pair of spaced peaks could replace the land 16 but nevertheless provide the necessary stability when the anchor is orientated as shown in FIG. 6. Further the forward end of the body member 4 could have a similar lug to lug 8 to receive a shackle for connection to a chain cable, or alternatively either or both lugs could have circular holes to receive shackle pins. The device 1 could be used with other forms of anchor than that shown, but is especially of value with fixed fluke anchors. FIGS. 8 and 9 show a modified form of anchor orientating device. The device 1 of FIGS. 8, 9 is so arranged that the pins 6A, 9A of the shackles 6, 9 are arranged parallel in contrast to the FIGS. 1 to 3 embodiment where these pins 6A and 9A are arranged at right angles to each other. Also, the transverse strengthening plates 10A are arranged lower ie. closer to the axis L—L than the corresponding plate 10A of the FIGS. 1 to 3 embodiment, and the plate 14 is now integral with the body member 4.

I claim:

1. An anchor orientating device characterised by including a body member elongated along an axis of the device adapted at a forward end for attachment to a cable and at an after end for attachment to an anchor shank or a cable and a transverse cam member attached to the body member and so adapted that the cam member can react with a first cylindrical firm surface to cause operative orientation of the device.

2. An anchor orientating device as claimed in claim 1, characterised in that the cam member bears a peripheral edge forming a stability creating surface means at one side of said axis and a non-stable second surface portion or peak at an opposite side of said axis whereby, on being dragged over a cylindrical firm surface with said second surface portion in contact with said firm surface, the device tends to topple away from the peak and roll on said cam member to bring the stability creating surface means into stable contact with said firm surface.

3. An anchor orientatin device as claimed in claim 2, characterised in that the stability creating surface means comprises a land.

4. An anchor orientating device as claimed in claim 2, characterised in that the stability creating surface means is closer to the axis of the device than the peak.

5. An anchor orientation device as claimed in claim 2, characterized in that secondary reaction surface means are provided and arranged to react with a second cylindrical firm surface of lesser diameter than said first cylindrical surface to cause tilting of the device.

6. An anchor orientating device as claimed in claim 5, characterized in that the secondary reaction surface means comprises an edge of a plate member which edge extends laterally beyond the stability creating surface means of the cam member.

7. An anchor orientating device as claimed in claim 6, characterized in that said edge includes an outer edge surface and a bevel surface flanking said outer edge surface.

8. An anchor orientating device as claimed in claim 7, characterized in that said outer edge surface is off-set from the vertical mid-plane of the device.

9. An anchor orientating device as claimed in claim 1, characterized in that a peak of the cam member is located forward of the stability creating surface means.

10. An anchor orientating device as claimed in claim 1, characterized in that the peripheral edge of the cam member is substantially contained in a plane.

11. An anchor orientating device as claimed in 10, characterized in that the plane of the periphery of the cam member is inclined to the axis of the device.

12. An anchor orientating device as claimed in claim 11, characterized in that the plane of the periphery of the cam member is inclined to the axis of the device in the range 40° to 80° and preferably 50° to 65°.

13. An anchor orientating device as claimed in claim 1, characterized in that the cam member periphery is of cardioid shape.

14. An anchor orientating device as claimed in claim 1, characterized in that secondary reaction surface means are provided and arranged to react with a second cylindrical firm surface of lesser diameter than said first cylindrical surface to cause tilting of the device.

15. An anchor orientating device as claimed in claim 14, characterized in that the secondary reaction surface means operatively react with a firm cylindrical surface of a diameter less than a predetermined size while precluding operation of said cam member with this cylindrical surface, and in that said cam member operatively reacts with a firm cylindrical surface of a diameter greater than a predetermined size while precluding engagemment of said secondary reaction surface means with the latter cylindrical surface.

16. An anchor orientation device as claimed in claim 1, characterized in that an aperture is provided at the after end of the body member to receive a joining shackle and arranged such that the shackle has limited degree of rotational freedom about said axis relative to the body member.

* * * * *